United States Patent [19]

Ivarsson et al.

[11] Patent Number: 4,945,971

[45] Date of Patent: Aug. 7, 1990

[54] LADDER CORDS FOR VENETIAN BLINDS

[76] Inventors: Sune I. Ivarsson, Tranerud 5591, S-662 02 Fängersfors; Sten A. Smederöd, Kyrkebacken 4, S-415 06 Göteborg; Karl-Erik Larsson, Pl 5544,, S-662 02 Fängersfors, all of Sweden

[21] Appl. No.: 357,472

[22] Filed: May 26, 1989

[30] Foreign Application Priority Data

Jan. 25, 1989 [SE] Sweden ..... 8900255
Mar. 1, 1989 [SE] Sweden ..... 8900697

[51] Int. Cl.[5] ..... E06B 9/38
[52] U.S. Cl. ..... 160/178.3
[58] Field of Search ..... 160/178.3, 168.1, 176.1, 160/173, 166.1; 139/384 A

[56] References Cited

U.S. PATENT DOCUMENTS 2,031,981 2/1936 Runge ..... 139/384 A
2,275,273 3/1942 Taylor ..... 160/178.3 X
3,256,928 6/1966 Hensel ..... 160/178.3
3,971,427 7/1976 Coldewey et al. ..... 160/168.1
4,154,281 5/1979 Schluep ..... 160/178.3
4,236,567 12/1980 Frentzel ..... 160/178.3
4,487,243 12/1984 Debs ..... 160/168.1
4,593,738 6/1986 Chi Yu ..... 160/176.1
4,621,673 11/1986 Georgopoulos et al. .... 160/178.3 X

FOREIGN PATENT DOCUMENTS 4972 of 1888 United Kingdom ..... 139/384 A

*Primary Examiner*—David M. Purol
*Attorney, Agent, or Firm*—Harness, Dickey & Pierce

[57] ABSTRACT

The lateral chain legs of ladder cords for Venetian blinds in accordance with the invention are formed with regularly spaced openings to allow mounting of the cord. This is made possible by cutting the ladder cord to the desired length and removing the transverse cross connectors at the end portions of the cord, whereupon the cord may be mounted with the aid of the openings in the header and bottom mounting rails of the blind and the ladder cord length can be adjusted to any blind length. When the ladder cord is intended for use with Venetian blinds of standard lengths the chain legs need be provided with mounting openings only at the end portions of the standard length ladder cords.

9 Claims, 4 Drawing Sheets

Fig.1
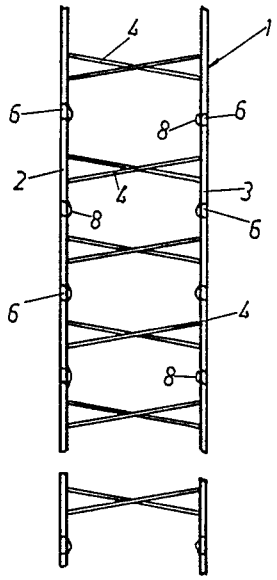
Fig.2
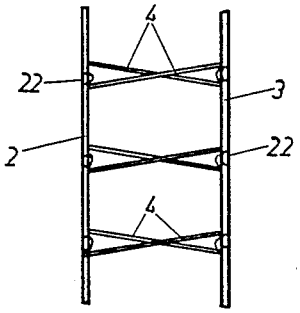
Fig.3
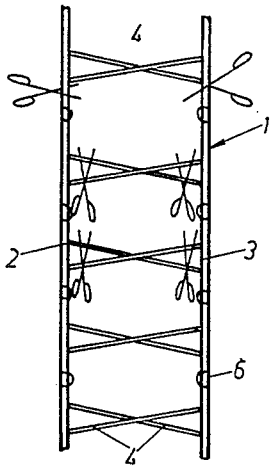
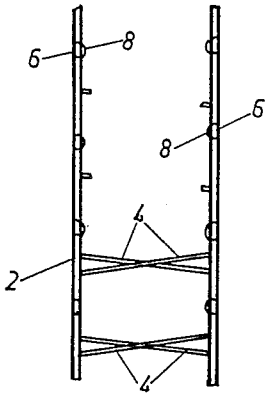
Fig.4

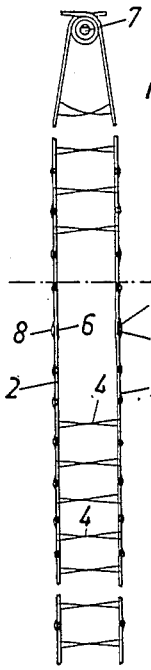
Fig.5
Fig.6
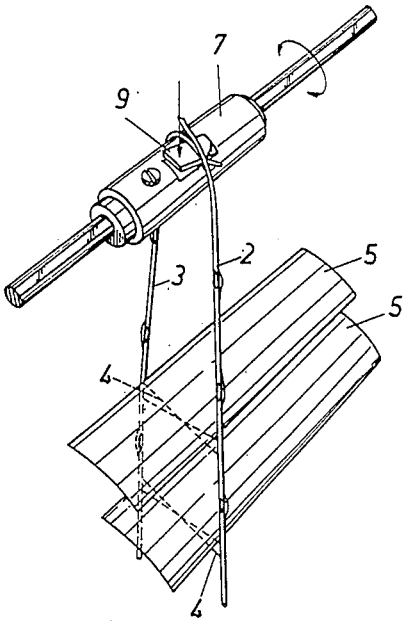
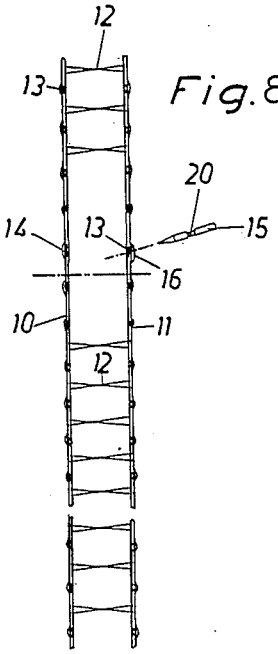
Fig.8
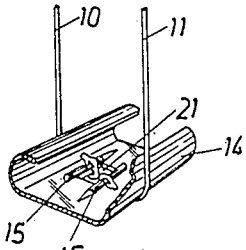
Fig.7
Fig.9
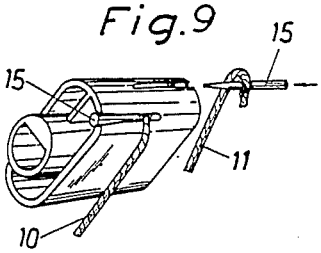

LADDER CORDS FOR VENETIAN BLINDS

BACKGROUND OF THE INVENTION

Ladder cords designed to be used in the mounting and installation of Venetian blinds consist of two lengthwise extending, parallel crochet-chain legs, and of a plurality of transverse webs or connectors extending crosswise between the lengthwise cord legs to support the slats of the Venetian blinds. Consequently, the cross connectors must be spaced apart a distance determined by the width of the slats. When the blind is mounted in position, for example in a window frame, the upper ends of the parallel cord legs must be secured in some way to the header rail so that the blind can be mounted in position in the window frame. Furthermore, the rail equipment necessary to operate the blind, i.e. must house ladder cord roller mounted on a slat tilt drive rod.

Hitherto, the mounting and installation of the blind consisted of several steps. Initially, a few of the cross connectors of the ladder cord were removed and the cord ends thus freed were carried into the header rail, where the cord ends were clamped in some way or other to the ladder cord roller. In addition to being a rather time-comsuming operation, it was also necessary to make sure that the ends, when clamped in position, were of exactly identical lengths, as uneven lengths would result in slat misalignment in the suspended blind.

SUMMARY OF THE INVENTION

The purpose of the subject invention is to remedy this drawback by providing a Venetian blind ladder cord which may be mounted and installed in an easier manner than has hitherto been possible and yet ensures a perfectly level position of the cord upon installation. This is achieved in accordance with the present invention whereby the parallel crochet-chain cord legs are provided with regularly spaced mounting openings.

BRIEF DESCRIPTION OF THE DRAWINGS

The invention will be described in closer detail in the following with reference to the accompanying drawings, wherein FIG. 1 illustrates a first embodiment of the invention, FIG. 2 illustrates a second embodiment of the invention, FIG. 3 illustrates the manner of preparing the ladder cord to allow it to be mounted and installed in accordance with the teachings of the invention, FIG. 4 shows the ladder cord thus prepared, FIGS. 5 and 6 illustrate the securement of the ladder cord to the upper ladder cord roller positioned on the tilt drive rod in the header rail, FIG. 7 is a perspective view of the manner of attachment of the ladder cord to the bottom rail of the blind, FIG. 8 illustrates the preparatory means for the attachment, FIG. 9 illustrates another way of attaching the ladder cord to the header rail.

Figure 10:
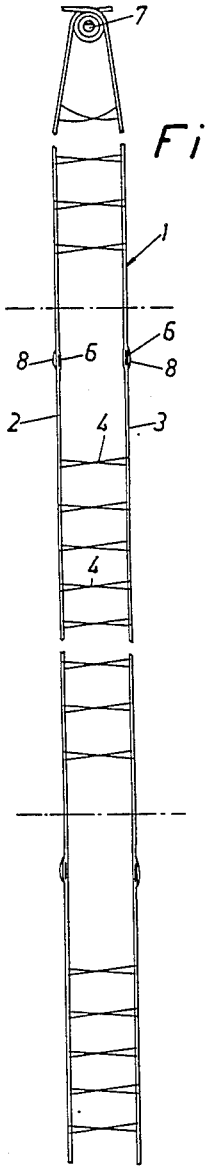
FIG. 10 is a plane view of a further embodiment of a ladder cord in accordance with the invention.

DETAILED DESCRIPTION OF PREFERRED EMBODIMENTS.

The ladder cord illustrated in FIG. 1 comprises two parallelly extending chain legs 2 and 3, preferably made by crocheting. Transverse webs 4 or cross connectors extend between the two parallel chain legs 2 and 3 for the purpose of supporting the slats of the Venetian blinds (see FIG. 6). In the manner illustrated, the cross connectors 4 consist of two crossing threads, an arrangement which serves to improve the stability of the slats 5 of the blind. The length of the cross connectors 4 and also the spacing between them are determined by the dimensions of the slats 5. The parallel chain legs 2 and 3 are formed with openings 6 which are produced as the two chain legs 2 and 3 are being crocheted. At the point where an opening is desired, one thread 8 is carried to the side of the chain legs 2, 3, preferably on their inner face where the openings are least visible, yet easy to find. The threads 8 indicate the positions of the openings 6, which is desirable for reasons to be explained in closer detail in the following description relating to the manner in which the ladder cord is attached to a fastener means, such as a ladder cord roller 7, which is positioned on the slat tilt drive rod inside the header mounting rail (see FIG. 6) of the blind.

When the Venetian blind is to be installed, the desired length of ladder cord 1 is first cut to measure, i.e. a piece of ladder cord corresponding to the length of the blind. Some of the cross connectors 4 are also removed at the upper end, as indicated by scissors in FIG. 3. When the ladder cord end is ready to be mounted, it has the appearance illustrated in FIG. 4.

To secure the parallel chain legs 2, 3 to the ladder cord roller 7 one proceeds in the manner appearing in FIG. 6, i.e. the chain legs are fastened to the ladder cord roller 7 by introduction of a metal tongue 9 formed on the roller through selected, oppositely positioned openings 6 in the chain legs, whereupon the metal tongue 9 is depressed into contact with the roller 7, locking the chain legs 2, 3 in position therebetween. In this manner, the exact position of the parallel chain legs 2, 3 is automatically ensured and consequently the Venetian blind slats 5 will assume the desired position when operated.

In accordance with the embodiment illustrated in FIGS. 7 and 8, the ladder cord, like the ladder cord in accordance with the embodiment of FIG. 1, comprises two parallel chain legs 10, 11 which are interconnected by regularly spaced cross connectors 12. Also, like the first embodiment, the parallel chain legs 10, 11 have openings 13 formed therein. The openings 13, which will be positioned at the bottom of the parallel chain legs after cutting off of the ladder cord (see dashed-and-dotted lines), are intended to secure the lowermost chain ends to a lower rail or bottom rod 14 (see FIG. 7). Like in the preceding embodiment, the thread 16, which is normally crocheted into the chain mesh at the point of the opening, is instead carried laterally of the chain legs at the levels of the openings 13. The purpose therefor is both to indicate the position of the openings and also to allow secure fastening of attachment pins 15. To fasten the pin 15 to the chain leg 11, the pin 15 is passed underneath the thread 16 positioned laterally from the chain leg at the opening 13 and through the opening. The pin 15 should be pushed sufficiently far through the opening to allow a narrower throat portion 20 on the pin to engage the thread 16 and the chain run, which provides for very safe securement of the pin. After insertion of the pin in the manner described, the pin is introduced through a slot 21 formed in the lower rail 14 in the manner indicated and it is secured in this position with absolute safety.

FIG. 9 illustrates an embodiment whereby the pin 15 is first fastened to the ladder cord in the manner illustrated with reference to FIG. 8. Thereafter the ladder cord with the pin 15 fastened thereto may be attached to a device corresponding to a ladder cord roller mounted on the slat tilt drive rod serving to operate the blind. This device or mechanism is positioned inside the header rail of the blind.

The openings 6 may be positioned either as illustrated in FIG. 1 halfway between the cross connectors 4, a position which by no means is the only one in accordance with the invention, or as indicated in FIG. 2, whereby the openings 22 are positioned opposite the cross connectors 4.

The ladder cord illustrated in FIG. 10 comprises parallel chain legs 2, 3 which are interconnected by cross connectors 4 intended to support the Venetian blind slats 5 (see FIG. 6). At its upper end, the ladder cord is attached to an operating mechanism or ladder cord roller 7 such that the parallel chain leg ends are secured to the operating mechanism 7 in the manner already described in closer detail with reference to FIG. 6.

In the embodiment of FIG. 10 the cross connectors have been eliminated from the ladder cord along a predetermined length at the bottom thereof and along a length in the middle of the cord where such connectors are usually provided. The parallel chain legs 2, 3 are provided with openings 6 along these lengths. The thread which would have formed the cross connector is instead carried laterally from its associated chain leg 2 or 3 in the form of a loop 8 which thus extends externally from the chain leg opposite the corresponding opening 6.

Figure 11:
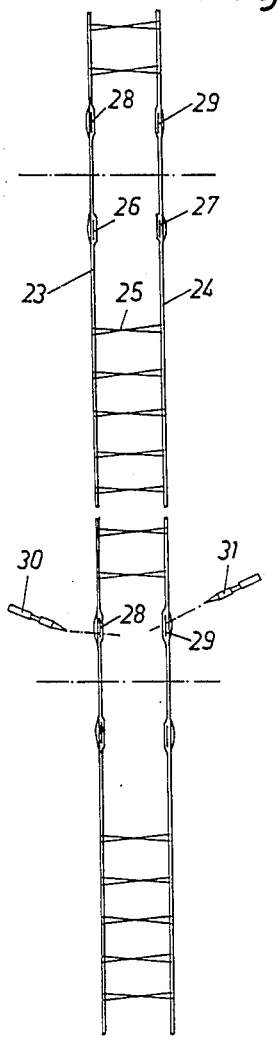
FIG. 11 is a plane view of the ladder cord and illustrates the manner of attachment of the cord to the bottom rail of the Venetian blind, shown in closer detail in FIG. 7.

FIG. 11 illustrates a somewhat modified embodiment of the ladder cord in accordance with the invention. In this case the ladder cord, just like the ladder cord in accordance with FIG. 10, comprises two parallel chain legs 23, 24 which are interconnected by cross connectors 25. Just like in the preceding embodiment, openings are formed in the chain legs at standard spacings but in this case two such openings 26, 27 and 28, 29, respectively, are provided. The openings 28, 29, which after cutting-off of the ladder cord will be positioned at the bottom of the chain legs (see dashed-and-dotted lines), are intended to secure the chain leg ends to a lower rail or bottom rod 14 (see FIG. 7). Just like in the previous embodiment, the threads, which would have formed the omitted cross connectors which have been omitted, are carried laterally from chain legs opposite their respective openings 26, 27, 28, 29. The reason therefore is, as has been mentioned in the aforegoing, to indicate the position of the openings as well as to allow safe securement of attachment pins 30, 31.

Figure 12:
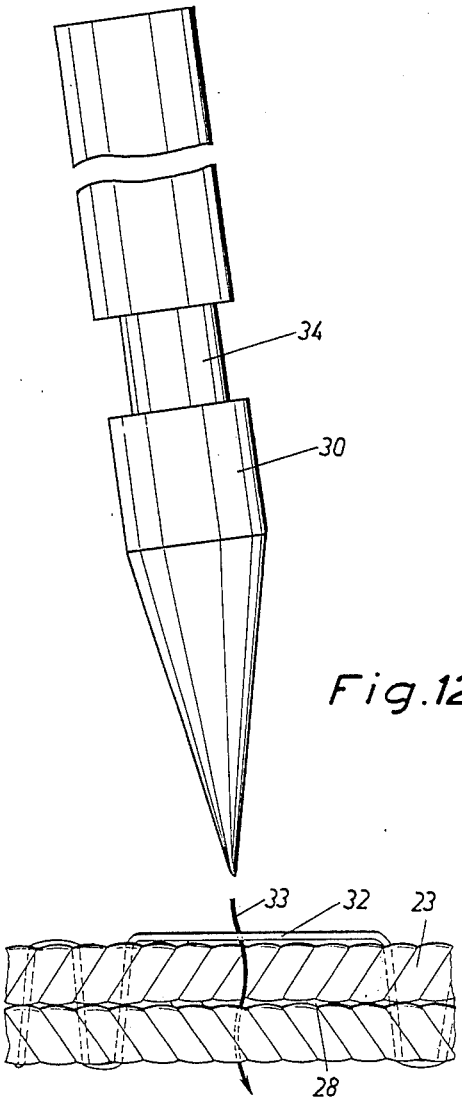
FIG. 12 illustrates, on a considerably enlarged scale, the manner of pushing a pin used to secure the ladder cord, through the ladder cord for securement thereto.

FIG. 12 illustrates on an enlarged scale the manner in which one such pin 30 is intended to be inserted into a chain leg 23 through an opening 28 with the aid from a thread 32 extending laterally of said opening 28. The manner of insertion is indicated in FIG. 12 by means of an arrow 33. The pin 30 is to be pushed sufficiently far into and through the opening to allow the neck portion 34 of the pin to engage the thread 32 and the a run of the chain leg 23, whereby secure attachment of the pin is obtained. After insertion of the pins in the manner described, the pins are introduced through a slot 21 (see FIG. 7) formed in the bottom rail 14 in the manner appearing in FIG. 7, ensuring that the pins are safely secured to the rail in this position.

The invention is not limited to the embodiments illustrated and described but several modifications are possible within the scope of the appended claims. The ladder cords could be secured in many different ways, provided the ladder cords are formed with openings in accordance with the invention. The modified embodiments of several invention provide the advantages in accordance with the invention, among which the time-saving aspect should be particularly emphasized since no cross connectors need to be cut away. In addition, mounting and installation of the blind is quicker and the ladder cords will always be mounted at the exactly correct level, owing to the openings which secure the chain legs. Attachment of the ladder cords be achieved in other ways than those described herein as would be obvious to one of ordinary skill in the art without explicit explanations and such ways are within the scope of the present invention.

In addition, it is not necessary that the spacings between the openings formed in the chains are the same as the spacings between the cross connectors. The invention makes the attachment of the ladder cords considerably easier and ensures that the cord will be mounted in the exactly correct position. The invention also provides the manufacturer of Venetian blind slats with ladder cords adjusted precisely to the lengths of blinds manufactured by him. Naturally it is also possible to adapt the ladder cords to blinds of made-to-measure dimensions, i.e. a blind having a length different from the standard ones.

What we claim is:

1. A ladder cord for a venetian blind comprising:

a pair of chain legs comprising a first chain leg and a second chain leg formed by crocheting and vertically aligned substantially parallel to each other;

a plurality of cross connectors formed from at least one continuous cross connector thread having portions integrated into said first and second chain legs and having portions extending crosswise between said first and second chain legs at predetermined intervals thereof to support slats of the venetian blind; and a pair of mounting openings comprising a first opening positioned at a predetermined height on said first chain leg and a second opening opposingly positioned on said second chain leg at a height substantially equal to the height of said first opening, wherein each mounting opening comprises a loop formed between one of said chain legs and an integral thread extending outwardly from said one of said chain legs and returning back into said same one of said chain legs and wherein each mounting opening is capable of receiving a venetian blind mounting means.

2. The ladder cord as claimed in claim 1, wherein said pair of openings is positioned on opposite chain legs substantially adjacent one of the plurality of cross connectors.

3. The ladder cord as claimed in claim 1, wherein said pair of openings is positioned on opposite chain legs substantially halfway between two of said plurality of cross connectors.

4. The ladder cord as claimed in claim 1, wherein at least one of said plurality of cross connectors is omitted at an interval determined by a predetermined length of the venetian blind, and wherein said pair of mounting openings is formed in said parallel chain legs spaced a predetermined distance from a closest remaining cross connector.

5. The ladder cord as claimed in claim 1, wherein one of said plurality of cross connectors is omitted from said ladder cord at the beginning thereof and one of said plurality of cross connectors is omitted at the end of a predetermined length of the ladder cord and wherein said pair of openings is formed on said ladder cord where said one of said plurality of cross connectors is omitted.

6. The ladder cord as claimed in claim 1, wherein said mounting means is a pin arranged to be inserted into said openings and into a mounting rail for securing said ladder cord to said mounting rail.

7. The ladder cord as claimed in claim 1, wherein said integral thread is said at least one continuous cross connector thread.

8. The ladder cord as claimed in claim 6, wherein said ladder cord is secured to said mounting rail at a lower end of said venetian blind.

9. The ladder cord as claimed in claim 6, wherein said ladder cord is secured to said mounting rail at an upper end of said venetian blind.

* * * * *